US009049887B2

(12) United States Patent
Ercelebi et al.

(10) Patent No.: US 9,049,887 B2
(45) Date of Patent: Jun. 9, 2015

(54) APPARATUS AND METHOD FOR LOADING CAVITIES OF PLUG SPACE PLUG FILTER ROD

(75) Inventors: Ahmet Ercelebi, Mechanicsville, VA (US); Martin T. Garthaffner, Chesterfield, VA (US); Barry S. Smith, Hopewell, VA (US); Georgios D. Karles, Richmond, VA (US); Jose Nepomuceno, Beaverdam, VA (US)

(73) Assignee: Philip Morris USA Inc., Richmond, VA (US)

( * ) Notice: Subject to any disclaimer, the term of this patent is extended or adjusted under 35 U.S.C. 154(b) by 967 days.

(21) Appl. No.: 13/071,606

(22) Filed: Mar. 25, 2011

(65) Prior Publication Data

US 2012/0028774 A1 Feb. 2, 2012

Related U.S. Application Data

(60) Provisional application No. 61/318,256, filed on Mar. 26, 2010.

(51) Int. Cl.

| | |
|---|---|
| ***B31C 99/00*** | (2009.01) |
| ***A24D 3/02*** | (2006.01) |
| ***A24D 3/06*** | (2006.01) |

(52) U.S. Cl.

CPC ..... *A24D 3/0225* (2013.01); *A24D 3/0216* (2013.01); *A24D 3/0287* (2013.01); *A24D 3/061* (2013.01)

(58) Field of Classification Search

CPC ..... A24D 3/048; A24D 3/061
USPC ..... 493/4, 39, 47–50; 131/202, 215.2
See application file for complete search history.

(56) References Cited

U.S. PATENT DOCUMENTS

| | | | | | |
|---|---|---|---|---|---|
| 2,219,491 | A | * | 10/1940 | Podmore | 493/39 |
| 3,010,561 | A | * | 11/1961 | Ricke | 198/452 |
| 3,259,029 | A | * | 7/1966 | Hall et al. | 493/4 |
| 3,312,152 | A | * | 4/1967 | Williamson | 493/47 |
| 3,550,508 | A | * | 12/1970 | Sprinkle et al. | 493/49 |
| 3,570,557 | A | * | 3/1971 | Molins | 141/99 |
| 3,957,563 | A | * | 5/1976 | Sexstone | 156/438 |
| 4,040,341 | A | * | 8/1977 | Molins et al. | 493/39 |
| 4,103,596 | A | * | 8/1978 | Molins | 493/39 |

(Continued)

FOREIGN PATENT DOCUMENTS

WO WO 03/016137 A1 2/2003

OTHER PUBLICATIONS

International Preliminary Report on Patentability Issued Oct. 2, 2012 for PCT/IB2011/001132.

*Primary Examiner* — Stephen F Gerrity
*Assistant Examiner* — Eyamindae Jallow
(74) *Attorney, Agent, or Firm* — Buchanan Ingersoll & Rooney PC

(57) ABSTRACT

An apparatus for serially delivering filling media to spaced apart cavities of an endless filter rod, which includes a conveyor which conveys a strip of plug wrap along a feed path, a transfer wheel arrangement which serially delivers filter segments to the plug wrap as it moves along the feed path such that the filter segments are arranged in plug-space-plug relation with cavities separated by the filter segments, and a filling wheel which rotates about a horizontal axis and includes pockets or cleats which receive filling media at the loading zone and deliver the filling media to the cavities at a discharge station along the feed path.

12 Claims, 3 Drawing Sheets

(56) References Cited

U.S. PATENT DOCUMENTS

| | | | | |
|---|---|---|---|---|
| 4,411,640 | A * | 10/1983 | Hall | 493/45 |
| 4,780,988 | A * | 11/1988 | Mielke et al. | 47/58.1 R |
| 5,613,504 | A * | 3/1997 | Collins et al. | 131/94 |
| 5,695,441 | A * | 12/1997 | Irikura | 493/47 |
| 5,875,824 | A | 3/1999 | Atwell et al. | |
| 6,805,174 | B2 * | 10/2004 | Smith et al. | 141/67 |
| 6,837,281 | B2 | 1/2005 | Spiers et al. | |
| 7,381,175 | B2 * | 6/2008 | Dawson et al. | 493/47 |
| 7,479,099 | B2 | 1/2009 | Scott et al. | |
| 7,922,638 | B2 * | 4/2011 | Draghetti et al. | 493/39 |
| 8,291,916 | B2 * | 10/2012 | Belcastro et al. | 131/94 |
| 8,337,374 | B2 | 12/2012 | Garthaffner et al. | |
| 8,496,569 | B2 * | 7/2013 | Balletti et al. | 493/39 |
| 2005/0282693 | A1 | 12/2005 | Garthaffner et al. | |
| 2006/0112964 | A1 | 6/2006 | Jupe et al. | |
| 2009/0039102 | A1 | 2/2009 | Garthaffner et al. | |
| 2009/0145724 | A1 | 6/2009 | Garthaffner et al. | |
| 2009/0166376 | A1 | 7/2009 | Garthaffner et al. | |
| 2013/0123085 | A1 * | 5/2013 | Hoffmann | 493/4 |

* cited by examiner

DEATAIL A

APPARATUS AND METHOD FOR LOADING CAVITIES OF PLUG SPACE PLUG FILTER ROD

CROSS REFERENCE TO RELATED APPLICATION

This application claims priority under 35 U.S.C. §119(e) to U.S. Provisional Application No. 61/318,256, filed on Mar. 26, 2010, the entire content of which is incorporated herein by reference.

BACKGROUND

The present invention relates to a method and an apparatus for producing filter rods having plug-space-plug configurations, which are segmented and attached to tobacco rods of cigarettes.

Cigarettes typically comprise a wrapped tobacco column that optionally is tipped with a filter. The filter, in turn, may optionally be a composite filter comprising a plurality of (possibly dissimilar) filter rod segments. The dissimilar filter rod segments making up the composite filter may, for example, include different base filter materials or may comprise the same base filter material, but with alternate segments being impregnated with a particulate material such as carbon particles. Alternatively, the filter may comprise spaced apart filter material segments with cavities therebetween for receiving adsorbent particles such as carbon granules, beads or capsules.

Known apparatuses for the production of composite filters suffer from the disadvantage that the plurality of filter rod segments making up the composite filter, having been assembled into the desired combined filter configuration by the combining device, may not register with filling apparatus which inserts granular, beads or capsules in the cavities.

SUMMARY

In order to overcome the disadvantages associated with known apparatus, it would be desirable to provide apparatus for the production of composite cigarette filters that allows for increased precision during filling of the cavities in plug-space-plug filters.

In accordance with one embodiment, an apparatus for serially delivering filling media to spaced apart cavities of an endless filter rod comprises a conveyor which conveys a strip of plug wrap along a feed path, a transfer wheel arrangement which serially delivers filter segments to the plug wrap as it moves along the feed path such that the filter segments are arranged in plug-space-plug relation with cavities separated by the filter segments, a supply of filling media located at a loading zone, the filling media comprising granular material, beads or capsules, a filling wheel which rotates about a horizontal axis and includes pockets or cleats which receive filling media at the loading zone and deliver the filling media to the cavities at a discharge station along the feed path, the cleats and pockets being arranged on an outer surface of the wheel in spaced apart relation so as to register with the spaced apart cavities, and a drive mechanism which synchronizes rotation of the filling wheel with the transfer wheel arrangement such that the pockets or cleats arrive at the discharge station at the same time the cavities arrive at the discharge station.

In accordance with another embodiment, a method of serially delivering filling media to cavities of an endless filter rod moving along a feed path, comprises conveying a strip of plug wrap along a feed path, feeding filter segments to a transfer wheel arrangement and serially delivering the filter segments to the plug wrap as it moves along the feed path such that the filter segments are arranged in plug-space-plug relation with cavities separated by the filter segments, rotating a filling wheel about a horizontal axis such that pockets or cleats on the filling wheel receive filling media at a loading zone and deliver the filling media to the cavities at a discharge station along the feed path, the cleats and pockets being arranged on an outer surface of the wheel in spaced apart relation so as to register with the spaced apart cavities, and rotating the filling wheel and the transfer wheel arrangement with a drive mechanism which synchronizes rotation of the filling wheel with the transfer wheel arrangement such that the pockets or cleats arrive at the discharge station at the same time the cavities arrive at the discharge station.

BRIEF DESCRIPTION OF THE DRAWINGS

An apparatus for filling cavities in a filter rod is described in the following with reference to the accompanying drawings.

DETAILED DESCRIPTION

Figure 1:
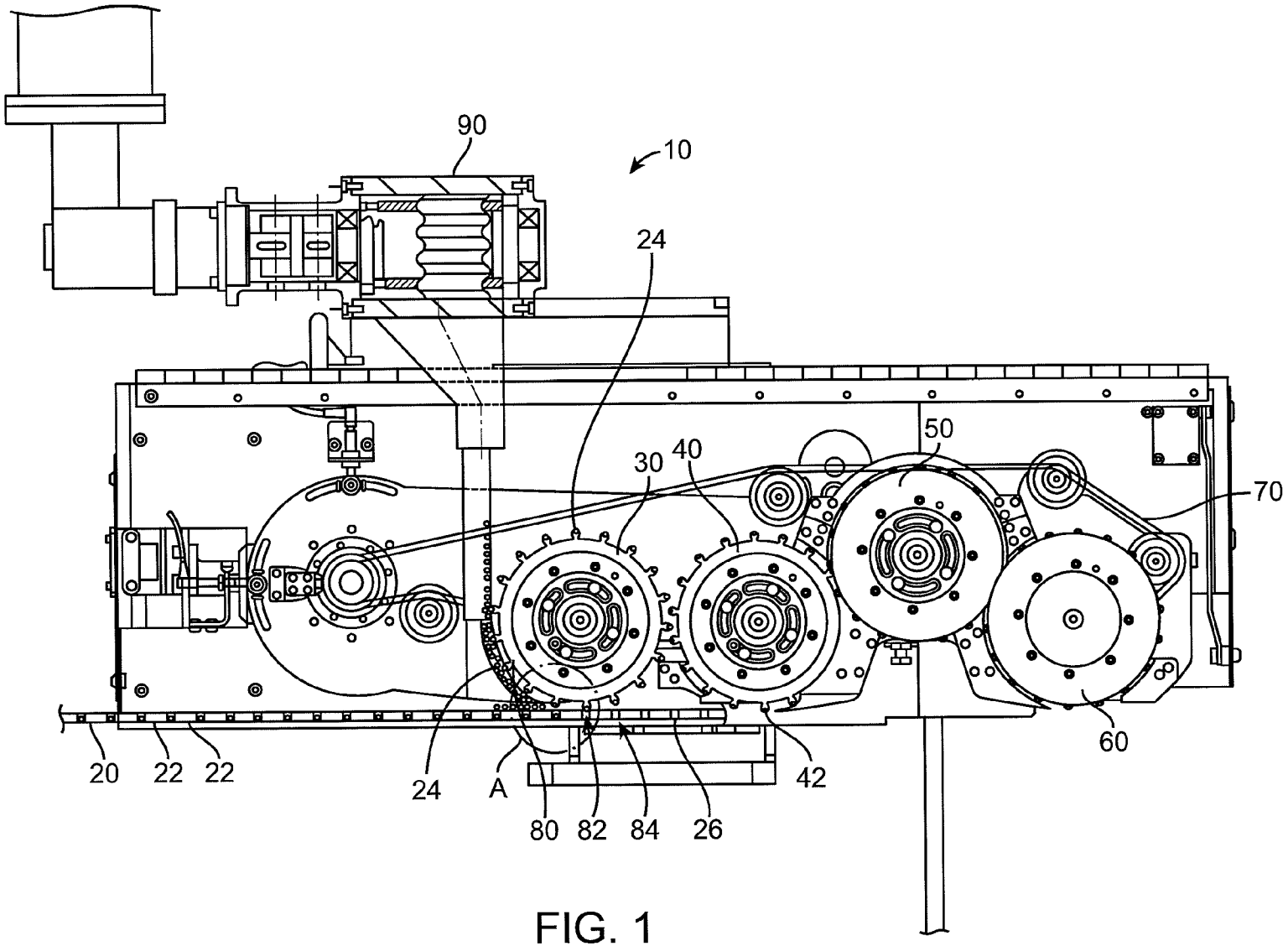
FIG. 1 is a diagrammatic side elevational view of the apparatus.

FIG. 1 schematically illustrates apparatus 10 for continuously producing filter rods 20 wherein filter segments 22 are delivered by a transfer wheel arrangement 40, 50, 60 to the surface of an endless plug wrap to which adhesive has been applied by a glue applicator. The plug wrap is drawn from a bobbin (not shown) and conveyed along a feed path by a conveyor (not shown), and the filter segments 22 are placed onto the plug wrap in precisely spaced apart relationship.

The plug wrap is partially folded around the spaced apart filter segments 22 by a garniture (not shown) and filling media 24 such as granular material, beads or capsules is then deposited in cavities 26 between the filter segments 22 by a filling wheel 30. In accordance with an exemplary embodiment, the filling media 24 is provided to the apparatus 10 by a media supply assembly 90. In order to provide registration between filling cleats 32 (FIG. 2) of the wheel 30 and the cavities 26, the wheel 30 can be synchronized with the transfer wheel assembly 40, 50, 60. The wheels 40, 50, 60 of the transfer wheel assembly can be linked to wheel 30 for synchronized rotation by a drive chain 70. In operation, vacuum applied to the filling cleats 32 picks up filling media at loading zone 80, the wheel 30 rotates clockwise and releases the vacuum at a 5:30 o'clock position to accommodate transfer of the media 24 and at the 6:00 o'clock position slightly pressurized air facilitates transfer of the media into a respective cavity 26 at a discharge station 82 along the feed path. Any overfeed of media 24 can be collected and recycled to the loading zone 80.

The transfer wheel assembly (or arrangement) 40, 50, 60 serially delivers filter segments arranged in plug-space-plug relation with the cavities 26 separated by the filter segments 22. As shown in FIG. 1, wheel 40 rotates clockwise, wheel 50 rotates counterclockwise, and wheel 60 rotates clockwise, which delivers the plug-space-plug configuration to the discharge station 82. A clockwise rotation of the drive chain (or drive mechanism) 70 synchronizes the rotation of the filling wheel 30 with the transfer wheel assembly (or arrangement) 40, 50, 60, such that the pockets or cleats 32 arrive at the discharge station 82 at the same time the cavities 26 arrive at the discharge station 82. In accordance with an exemplary embodiment, the filling media 24 comprises beads and the filling wheel 30 includes cleats 32, which pick up a bead at the loading zone 80 and hold the bead under vacuum as the filling wheel 30 rotates from the loading zone 80 to a transfer zone 84 upstream from the discharge station 82.

Figure 2:
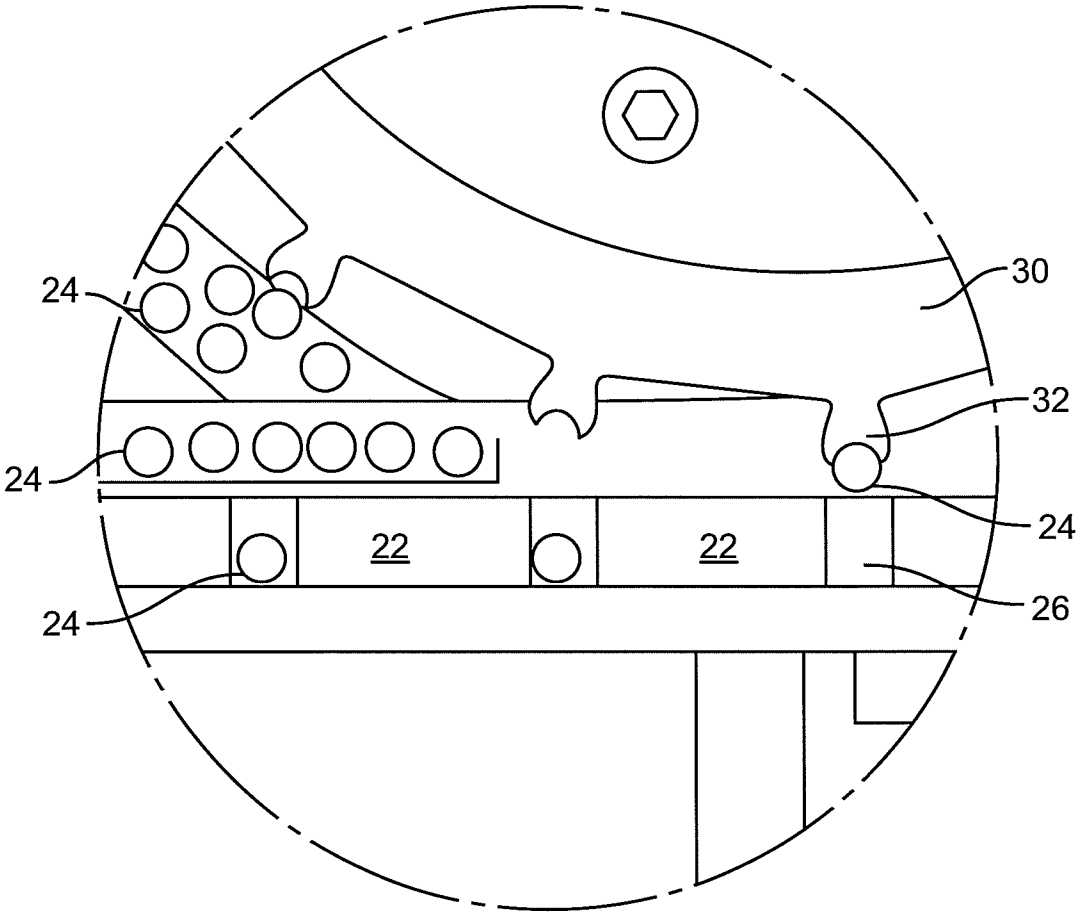
FIG. 2 is an enlarged view of detail A from FIG. 1.

As shown in FIG. 2, the filling wheel 30 has spaced apart cleats 32 on its outer surface and the cleats 32 are sized to fit in the cavities 26. Each cleat 32 has a concave shape matching the filling media 24, which is preferably a bead or capsule and vacuum can be applied to the cleats 32 during rotation from the loading zone 80 to the discharge station 82.

Figure 3:
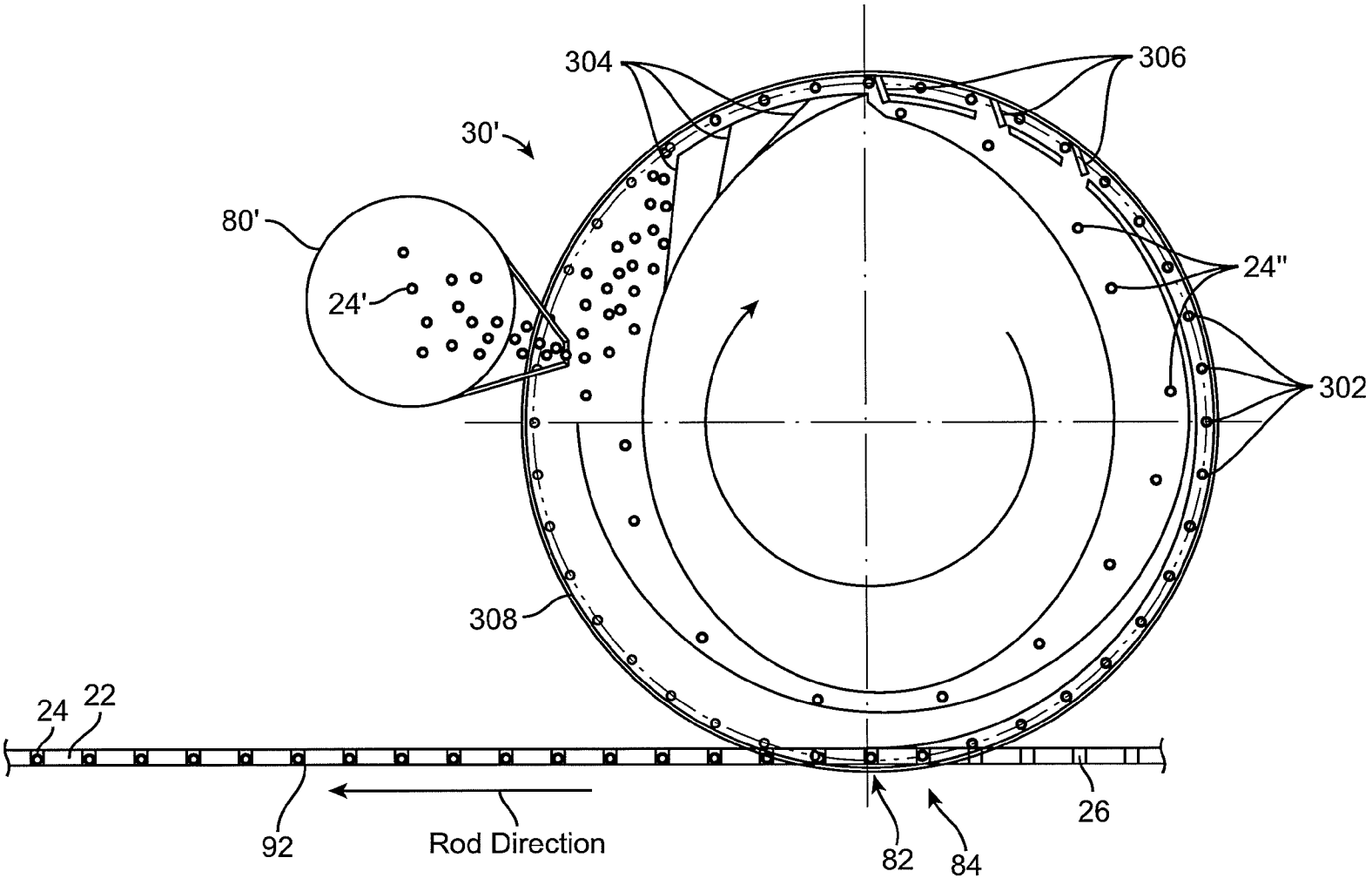
FIG. 3 is a schematic side elevational view of a filling wheel, which can be used in the apparatus shown in FIG. 1.

FIG. 3 shows details of a filling wheel 30', which can be used in the apparatus of FIG. 1. The wheel 30' is driven about a horizontal axis by the drive train 70 to match the linear speed of the plug-space-plug endless rod 92 to be filled. The wheel 30' includes pockets 302 sized to match the size and geometry of the filling media 24' and are patterned to match the plug-space-plug configuration of the endless rod 92. The filling media 24' is introduced to the wheel 30' at loading zone 80' and as the wheel 30' rotates diverters 304 force the filling media 24' to fill the pockets 302 and brushes 306 over the top of the pockets direct the excess filling media away from the pockets 302. The excess filling media 24" can be reintroduced to the loading zone 80'. A stationary plate 308 surrounds the wheel 30' and prevents the filling media from exiting the pockets 302 until the pocket 302 coincides with a cavity 26 to be filled. At that point, a cutout on the stationary plate 308 provides the opening for the filling media 24' to be transferred to the cavity 26. Slight air pressure can be used to facilitate discharge of the filling media 24' from the pocket 302.

In an embodiment, the apparatus can be used to load granular material in the cavities wherein filling wheel 30' includes equally spaced apart exterior pockets 302 on the circumferences of the wheel for receiving granular material from the loading zone 80'. Vacuum may be connected to selected pockets 302 to effect deposit of the granular material into the pockets and ultimate removal from the filling wheel 30'. The plug wrap is partially folded around the spaced apart filter segments 22 by a garniture and the filling media is then deposited in the cavities 26 between the filter segments by the filling wheel 30'.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

The invention claimed is:

1. An apparatus for serially delivering beads to spaced apart cavities of an endless filter rod comprising:

a conveyor, which conveys a strip of plug wrap along a feed path;

a transfer wheel arrangement which serially delivers filter segments to the plug wrap as it moves along the feed path such that the filter segments are arranged in plug-space-plug relation with cavities separated by the filter segments;

a supply of beads located at a loading zone;

a filling wheel which rotates about an axis and includes pockets, which receive beads at the loading zone and deliver the beads to the cavities at a discharge station along the feed path, the pockets being arranged on an outer surface of the wheel in spaced apart relation so as to register with the spaced apart cavities, wherein the filling wheel includes at least one diverter configured to divert the beads into the pockets and at least one brush which brushes over the top of the pockets to prevent overfilling of the pockets, each of the pockets delivering the beads to a respective one of the cavities at the discharge station during rotation of the filling wheel, and wherein the at least one diverter and the at least one brush recirculate excess beads to the loading zone; and a drive mechanism, which synchronizes rotation of the filling wheel with the transfer wheel arrangement such that the pockets arrive at the discharge station at the same time the cavities arrive at the discharge station.

2. The apparatus of claim 1, wherein the beads are held under vacuum as the filling wheel rotates from the loading zone to a transfer zone upstream from the discharge station.

3. The apparatus of claim 1, wherein the filling wheel includes vacuum connected to selected pockets to effect delivery of the beads to the cavities.

4. The apparatus of claim 1, wherein the transfer wheel arrangement includes three wheels and a drive train, which drives the three wheels and the filling wheel in synchronized rotation.

5. The apparatus of claim 1, comprising:

a stationary plate, which surrounds the filling wheel and is configured to prevent the beads from exiting the pockets until the pocket coincides with the cavity to be filed.

6. The apparatus of claim 1, wherein the discharge station is upstream of the loading zone.

7. The apparatus of claim 1, wherein the axis of rotation of the filling wheel is horizontal.

8. A method of serially delivering beads to cavities of an endless filter rod moving along a feed path, comprising:

conveying a strip of plug wrap along a feed path;

feeding filter segments to a transfer wheel arrangement and serially delivering the filter segments to the plug wrap as it moves along the feed path such that the filter segments are arranged in plug-space-plug relation with cavities separated by the filter segments;

rotating a filling wheel about an axis such that pockets on the filling wheel receive beads at a loading zone and deliver the beads to the cavities at a discharge station along the feed path, the pockets being arranged on an outer surface of the wheel in spaced apart relation so as to register with the spaced apart cavities, wherein the filling wheel includes at least one diverter configured to divert the beads into the pockets and at least one brush which brushes over the top of the pockets to prevent overfilling of the pockets, each of the pockets delivering the beads to a respective one of the cavities at the discharge station during rotation of the filling wheel;

rotating the filling wheel and the transfer wheel arrangement with a drive mechanism, which synchronizes rotation of the filling wheel with the transfer wheel arrangement such that the pockets arrive at the discharge station at the same time the cavities arrive at the discharge station; and recirculating excess beads that fail to find a pocket to the loading zone.

9. The method of claim 8, comprising:

holding the bead under vacuum as the filling wheel rotates from the loading zone to a transfer zone upstream from the discharge station.

10. The method of claim 8, comprising:

connecting a vacuum to selected pockets to effect delivery of the beads to the cavities.

11. The method of claim 8, wherein the transfer wheel arrangement includes three wheels and a drive train, which drives the three wheels and the filling wheel in synchronized rotation.

12. The method of claim 8, wherein the axis of rotation of the filling wheel is horizontal.

* * * * *